US006098671A

United States Patent [19]

Richardson, III

[11] Patent Number: 6,098,671

[45] Date of Patent: Aug. 8, 2000

[54] APPARATUS AND METHOD FOR MEASURING AIR PRESSURE IN AN AIR JET LOOM REED

[75] Inventor: William H. Richardson, III, Greenville, S.C.

[73] Assignee: Palmetto Loom Reed Company, Inc., Greenville, S.C.

[21] Appl. No.: 09/096,413

[22] Filed: Jun. 11, 1998

[51] Int. Cl.[7] ..... D03J 1/00

[52] U.S. Cl. ..... 139/192; 139/1 C; 73/861.65; 73/756

[58] Field of Search ..... 139/192, 1 C; 73/861.65, 861.66, 756, 37.5, 196; 15/318

[56] References Cited

U.S. PATENT DOCUMENTS

| | | | |
|---|---|---|---|
| 4,606,152 | 8/1986 | Michihara et al. . | |
| 4,640,316 | 2/1987 | Wakai | 139/1 C |
| 5,237,717 | 8/1993 | Watson . | |
| 5,244,504 | 9/1993 | Watson | 139/1 C |
| 5,245,858 | 9/1993 | Takegawa . | |
| 5,628,565 | 5/1997 | Hagen et al. . | |

FOREIGN PATENT DOCUMENTS 09176937 7/1999 Japan .

OTHER PUBLICATIONS

Crab Checker (On–Loom type), Model TR–7100, Takayama Reed Co., Ltd. No date supplied.

Air Flow Radar (On–Loom type), Model TR–7200, Takayama Reed Co., Ltd. No date supplied.

Nozzle Inspector (On–Loom type), Model TR–7200, Takayama Reed Co., Ltd. No date supplied.

Air Checker (On–Loom type), Model TR–7100, Takayama Reed Co., Ltd. No date supplied.

Profile Reed Air Check System, Air Controller NP–30, Kiji Reed Co., Ltd. No date supplied.

Description Of Air–Jet–Reed Measuring Device for Air Jet Weaving Machines, Steven GmbH & Co. KG, 1993.

*Primary Examiner*—Andy Falik

*Attorney, Agent, or Firm*—Hardaway/Mann IP Group Nexsen Pruet Jacobs & Pollard, LLP

[57] ABSTRACT

An apparatus and method for measuring air pressure values within a channel of a loom reed is provided. An overhead roller is used to support a frame carrying a pair of pitot tubes for determining air pressure values within a channel of a loom reed. A air nozzle is provided a fixed distance from one of the pitot tubes and serves to direct a pressurized stream of air toward the pitot tube. Variations in the pressure readings from the air nozzle over the length of the reed can be used to verify or adjust the air flow properties of the reed. The pitot tubes can also be used to evaluate the relay nozzles of an air jet weaving machine.

3 Claims, 2 Drawing Sheets

APPARATUS AND METHOD FOR MEASURING AIR PRESSURE IN AN AIR JET LOOM REED

BACKGROUND OF THE INVENTION

The present invention relates to an apparatus useful for measuring air pressure in the reed groove of an air jet loom.

SUMMARY OF THE INVENTION

The present invention provides a useful measuring apparatus and process wherein a single device can perform a variety of separate air pressure monitoring functions which are need for the operation of an air jet loom. Prior art devices used to adjust air jet looms have provided methods to measure flow in the reed or flow at the auxiliary nozzle outlet, but there is no device known which allows calibration of both the reed and the nozzle on the loom. In a typical air jet loom, the weft is directed by an air jet into the reed groove or channel. Auxiliary air jet nozzles are provided at fixed intervals in a guide path along the reed groove. In order to have and maintain an efficient weaving process, it is necessary that the reed groove have a desired air flow profile as established at the time of manufacture of the reed. Further, it is necessary that the air flow profile of the reed, as influenced and established by the auxiliary relay nozzles, conform to optimal standards. Periodically, it is necessary to reevaluate the air flow of the reed itself as well as air flow properties as established by the auxiliary air relay nozzles.

Periodic evaluation and calibration of the reed and loom are necessary since a variety of factors influence the air flow properties of the loom. For instance, weaving efficiency may suffer from a dirty or damaged reed, particularly if the reed groove is affected. In addition, an occluded or damaged auxiliary air jet nozzle, a misaligned nozzle, poor air pressure supply, or a damaged solenoid control for the air jet nozzles, may all affect the weaving efficiency.

The present invention provides a single apparatus which can be used to measure the pressure profile of a reed. Further, the apparatus can be used to evaluate the auxiliary air jet nozzles, supplied nozzle pressure, and solenoid operation. The apparatus provides measurements which can be performed rapidly, require no specialized training, and can be carried out on a wide variety of different reed and loom models and manufacturers. The information provided by the measuring apparatus allows an immediate diagnosis of air flow related problems and provides one of ordinary skill in the art the information to undertake corrective action.

While a variety of instruments are known in the art for measuring and monitoring air flows associated with a air jet loom, such products are often difficult to set up and operate. Further, many such products are dedicated to a single loom manufacturer's product. Accordingly, there remains room for improvement within the art of pressure measuring apparatuses for air jet looms.

OBJECTS OF THE INVENTION

It is an object of the present invention to provide an apparatus useful in the construction of a reed having desirable air flow properties for use in an air jet loom.

It is a further object of this invention to provide an apparatus for measuring the pressure profile across a loom reed groove.

It is a more particular object of this invention to provide a pressure measuring apparatus which enables a rapid diagnosis of fault conditions which may affect the pressure profile of a an air jet weaving loom.

It is yet a further and more particular object of this invention to provide a pressure measuring apparatus which is compatible with a variety of different manufactures air jet loom machines.

These and other objects of the invention are provided by an apparatus for measuring air pressure comprising: a frame having a substantially horizontal arm portion, a first terminus, and a second terminus, the first and the second terminus each defining a respective lower surface having a plane beneath a plane of a lower surface of the arm portion; a vertical upright carried by the frame, the upright projecting above the frame and carrying a roller which can be positioned along a length of the upright; a first pitot tube carried by a rear surface of the first framed terminus; a second pitot tube carried by a rear surface of the second framed terminus; a first pressure gauge coupling in fluid communication with the first pitot tube; a second pressure gauge coupling in fluid communication with the second pitot tube; an air nozzle supported by the frame, an outlet of the air nozzle positioned a spaced distance from the rear of the frame and opposite of the second pitot tube; and, a coupling for receiving a compressed air source, the coupling in communication with an inlet of the air nozzle.

BRIEF DESCRIPTION OF THE DRAWINGS

The features of the present invention will become apparent to those skilled in the art to which the present invention relates from reading the following specification with reference to the accompanying drawings in which.

DETAILED DESCRIPTION OF A PREFERRED EMBODIMENT

The present invention provides an apparatus for measuring air pressure associated with an air jet loom and the channel of an air jet reed.

DETAILED DESCRIPTION

Figure 1:
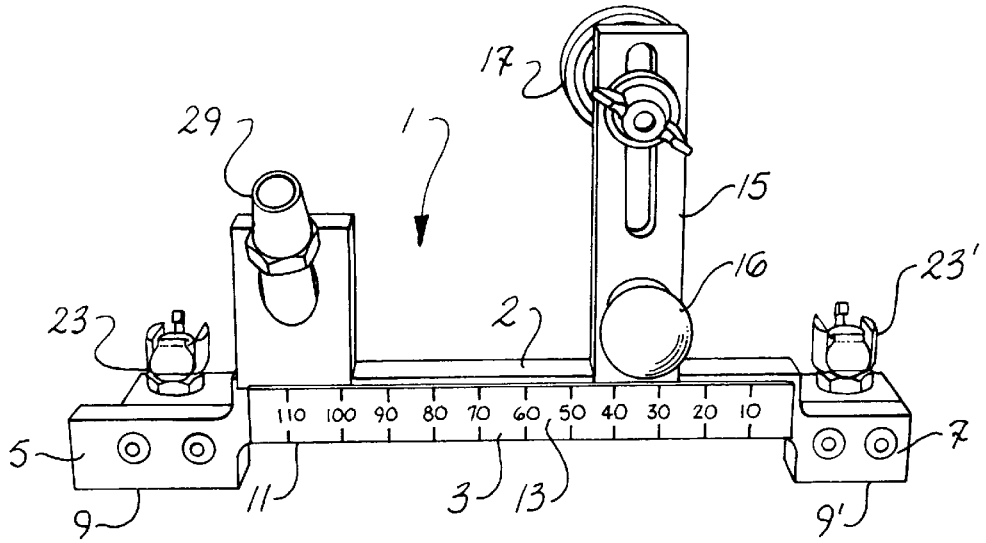
FIG. 1 is a perspective view of a front side of a preferred embodiment of a measuring apparatus in accordance with this invention.
Figure 2:
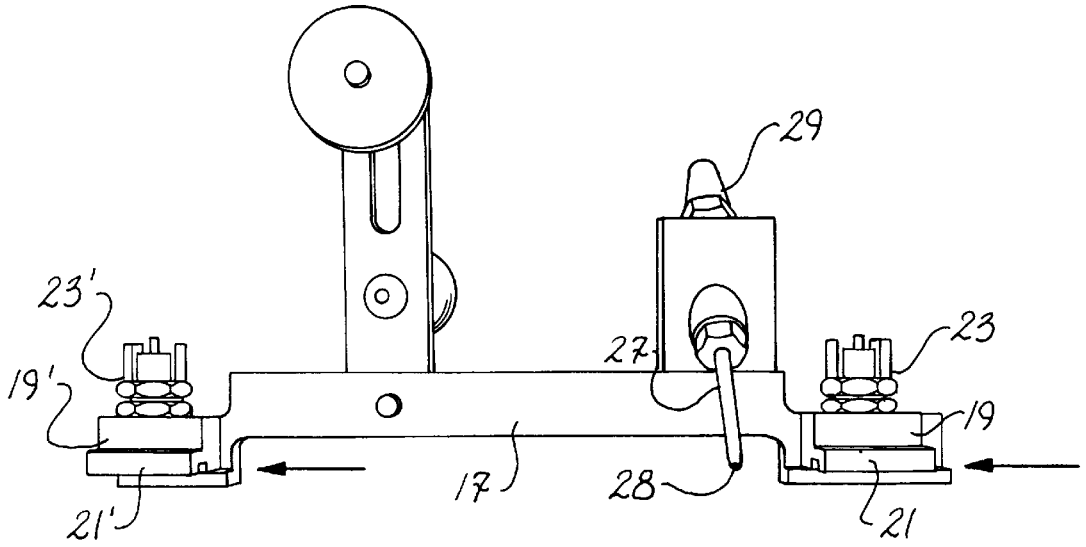
FIG. 2 is a perspective view of a rear side of the preferred embodiment seen in FIG. 1.
Figure 3:
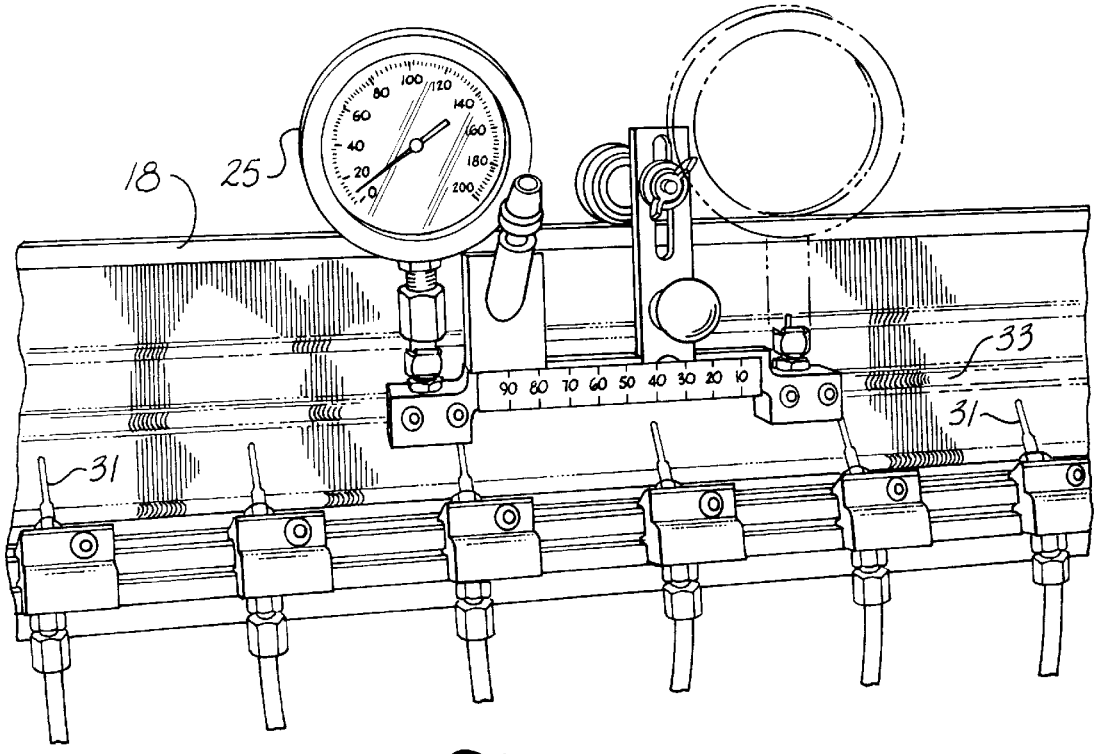
FIG. 3 is a perspective view of the front of an air jet loom showing the present invention operatively positioned adjacent the reed.

As seen in reference to FIGS. 1–3, an apparatus is provided for measuring air flow pressure values associated with an air jet loom. As described below, the apparatus permits two discrete measuring functions to be performed. First, the apparatus allows measurement of air flow properties across the channel or air guide of the reed. Secondly, the apparatus allows the pressure reading of each air jet of an air jet loom to be determined. The apparatus permits rapid diagnosis of air flow related problems and facilitates the proper calibration and maintenance of an air jet weaving machine for optimal weaving efficiency.

As seen in FIG. 1, the apparatus 1 comprises a frame 2 having a horizontal arm portion 3 which terminates at a first terminus 5 and a second opposing terminus. Each terminus 5 and 7 defines a lower surface and 9 and 9' respectively, which occupies a plane beneath a plane defined by a lower surface 11 of arm portion 3. A front face 13 defines a plurality of distance calibration markings.

A vertical upright 15 supports an adjustable roller 17. Roller 17 is designed to engage the upper surface of a reed or reed sley 18. (FIG. 3) and is positioned relative to the upright 15 so that frame 2 can be operatively positioned relative to an air jet reed. A handle 16 is also carried by upright 15 to assist in positioning apparatus 1. A rear surface 17 of frame 2 carries a first spacer 19 and a second spacer 19', each spacer carried by the rear surface of each terminus 7 and 7' respectively. A rear of each spacer of 19 and 19' carries a pitot tube 21 and 21' respectively. As seen in FIG. 2, the inlet portion of each pitot tube is positioned to receive air flow as seen by the directional arrows. Each pitot tube 21 and 21' is in communication with a respective pressure gauge coupling, 23 and 23'. Each coupling 23 and 23' are designed to reversibly mate with a pressure gauge 25, permitting pressure measurements to be determined at each pitot tube location.

As seen in FIGS. 2 and 3, spacers 19 and 19' are used to position the associated pitot tubes 21 and 21' within the air guide channel of a reed. In this manner, air flow and air pressure within the channel can be measured.

As best seen in FIG. 1, a relay nozzle 27 is also carried by frame 2. Air relay nozzle 27 is similar to relay nozzles used on air jet weaving machines and is positioned such that an outlet 28 of nozzle 27 is positioned opposite the sensing portion of pitot tube 21'.

As seen in FIG. 2, relay nozzle 27 is supported at an oblique angle by a separate support block carried on the upper surface of frame arm 3. However, a variety of positioning mechanisms are possible that would properly position an outlet 28 of nozzle 27 relative to the air guide channel of a reed. An inlet 29 of nozzle 27 is in communication with a coupling adapted to connect to an external source of pressurized air.

In a first mode of operation, frame 2 is positioned opposite a reed. Pressurized air is directed through inlet 29 of air relay nozzle 27 and exit nozzle 28 at a right angle and in the direction of pitot tube 21'. The distance between air jet 27 and pitot tube 21' is fixed. In conjunction with a known pressure of externally supplied air, a desired pressure value exists and can be compared to the measured value determined by pressure gauge 25. As such, the entire length of an air reed channel can be measured for a desired air flow pressure. Variations from a target value indicate the need for cleaning or other routine maintenance of a portion of the reed. The present invention is also useful in the manufacturing of a new reed to ensure desired air flow properties across the air reed conform to manufacturing specifications.

In a second mode of operation, the apparatus 1 is used to measure air flow across an air jet loom. As seen in reference to FIG. 3, a typical air jet loom comprises a plurality of nozzles 31 which direct a variable stream of compressed air along with a channel 33. The movement of air from nozzles 31 carries a thread/yarn which is inserted in the weaving process.

The apparatus 1 is installed such that roller 17 engages an upper edge or sley 18 of a reed while positioning the pitot tube 21 and 21' within the channel of the reed. In reference to pitot tube 21', tube 21' is positioned a predetermined distance from an air jet nozzle 31. The calibration on the front surface of arm 3 is used to determine the appropriate distance. The actual distance used will vary among machines depending upon the manufacturers specification. Pressure readings are taken directly from gauge 25. Preferably, the inlet of gauge 25 defines a small orifice of approximately $1/10{,}000$'s of an inch. The small orifice has been found to dissipate fluctuations or drifts in the pressure measurements so that a quicker, more rapid and more accurate pressure reading is obtained.

Gauge 25 may be mounted on either coupling. Coupling 23 is provided so that the apparatus can measure pressure of the air jets located on the far left side of a loom (as seen in reference to FIG. 3.) The design of the measuring apparatus 1 is such that the apparatus can freely slide along the length of the reed as installed in association with an air jet weaving machine. Other measuring devices known within the art require that the apparatus be removed each time an air jet nozzle is encountered. The present invention greatly simplifies and facilitates the monitoring and maintenance of air flow characteristics of an air jet weaving machine. Additionally, the present apparatus provides two discrete functions of monitoring the air flow properties of the reed, as well as separate monitoring of the air flow properties of each air jet nozzle or weaving machine.

I claim:

1. An apparatus for measuring pressure within a channel of a loom reed comprising:

a frame having a substantially horizontal arm portion, a first terminus, and a second terminus, said first and said second terminus each defining a respective lower surface having a plane beneath a plane of a lower surface of said arm portion;

a vertical upright carried by said frame, said upright projecting above said frame and carrying a roller positionable along a length of said upright;

a first pitot tube carried by a rear surface of said first frame terminus;

a second pitot tube carried by a rear surface of said second frame terminus;

a first pressure gauge coupling in fluid communication with said first pitot tube;

a second pressure gauge coupling in fluid communication with said second pitot tube;

an air nozzle supported by said frame, an outlet of said air nozzle positioned a spaced distance from said rear of said frame and opposite of said second pitot tube; and, a coupling adapted for receiving a compressed air source, said coupling in communication with an inlet of said air nozzle.

2. A process for measuring air flow within a channel of a loom reed comprising:

supplying an apparatus comprising a frame having a substantially horizontal arm portion, a first terminus, and a second terminus, said first and said second terminus each defining a respective lower surface having a plane beneath a plane of a lower surface of said arm portion;

a vertical upright carried by said frame, said upright projecting above said frame and carrying a roller positionable along a length of said upright;

a first pitot tube carried by a rear surface of said first frame terminus;

a second pitot tube carried by a rear surface of said second frame terminus;

a first pressure gauge coupling in fluid communication with said first pitot tube;

a second pressure gauge coupling in fluid communication with said second pitot tube;

an air nozzle supported by said frame, an outlet of said air nozzle positioned a spaced distance from said rear of said frame and opposite of said second pitot tube; and, a coupling adapted for receiving a compressed air source, said coupling in communication with an inlet of said air nozzle;

positioning said apparatus with said roller operatively engaging an upper edge of a reed and further positioning said first pitot tube within said channel and at a predetermined distance from a first auxiliary air source;

measuring the air pressure within said channel with said first pitot tube;

repeating said positioning and said measuring steps for each additional auxiliary air source in communication with said channel.

3. A process for determining air flow properties within a channel of a loom reed comprising:

supplying an apparatus comprising a frame having a substantially horizontal arm portion, a first terminus, and a second terminus, said first and said second terminus each defining a respective lower surface having a plane beneath a plane of a lower surface of said arm portion;

a vertical upright carried by said frame, said upright projecting above said frame and carrying a roller positionable along a length of said upright;

a first pitot tube carried by a rear surface of said first frame terminus;

a second pitot tube carried by a rear surface of said second frame terminus;

a first pressure gauge coupling in fluid communication with said first pitot tube;

a second pressure gauge coupling in fluid communication with said second pitot tube;

an air nozzle supported by said frame, an outlet of said air nozzle positioned a spaced distance from said rear of said frame and opposite of said second pitot tube; and, a coupling adapted for receiving a compressed air source, said coupling in communication with an inlet of said air nozzle;

positioning said apparatus with said roller operatively engaging an upper edge of a reed and further positioning said air nozzle outlet and said second pitot tube within said channel;

supplying a pressurized fluid through said nozzle outlet and into said channel, said fluid having a known value exiting said outlet nozzle and said fluid traveling in the direction of said second pitot tube;

monitoring a value of said pressurized fluid along a length of said channel, said value being ascertained from a pressure gauge in communication with said second pressure gauge coupling; and, adjusting said channel until a target value of air flow is achieved along a length of said channel.

* * * * *